US007718018B2

(12) United States Patent
Serizawa et al.

(10) Patent No.: US 7,718,018 B2
(45) Date of Patent: May 18, 2010

(54) METHOD OF COOLING STEEL PLATE

(75) Inventors: Yoshihiro Serizawa, Tokyo (JP); Ryuji Yamamoto, Tokyo (JP); Shigeru Ogawa, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 153 days.

(21) Appl. No.: 12/087,947

(22) PCT Filed: Jul. 25, 2007

(86) PCT No.: PCT/JP2007/065032

§ 371 (c)(1),
(2), (4) Date: Jul. 17, 2008

(87) PCT Pub. No.: WO2008/035510

PCT Pub. Date: Mar. 27, 2008

(65) Prior Publication Data

US 2009/0121396 A1 May 14, 2009

(30) Foreign Application Priority Data

Sep. 19, 2006 (JP) ..... 2006-252336

(51) Int. Cl.
*C21D 9/573* (2006.01)
*C21D 1/667* (2006.01)
*B21B 45/02* (2006.01)

(52) U.S. Cl. ..... 148/661; 148/559; 148/579; 148/625; 148/636; 148/637; 148/638; 148/639; 148/644; 148/656; 148/657; 148/658; 148/660; 148/662; 148/664; 266/46; 266/259; 266/114; 266/115

(58) Field of Classification Search ..... 148/559, 148/579, 625, 636–639, 644, 656–658, 660–662, 148/664; 266/46, 259, 114–115
See application file for complete search history.

(56) References Cited

FOREIGN PATENT DOCUMENTS

| | | |
|---|---|---|
| JP | 60-87914 | 5/1985 |
| JP | 61-001420 | 1/1986 |
| JP | 62-130222 | 6/1987 |
| JP | 63-13610 | 1/1988 |

(Continued)

OTHER PUBLICATIONS

International Search Report dated Nov. 6, 2007 issued in corresponding PCT Application No. PCT/JP2007/065032.

(Continued)

*Primary Examiner*—Roy King
*Assistant Examiner*—Lois Zheng
(74) *Attorney, Agent, or Firm*—Kenyon & Kenyon LLP

(57) ABSTRACT

A method of cooling both surfaces of steel plate, which stably secures precision of cooling control from a start of cooling to an end so as to uniformly cool the top and bottom surfaces of the steel plate and thereby stably secures the steel plate quality and cools the steel plate down to a target temperature with a good precision. The method comprises dividing a steel plate cooling region into at least a spray impact part region and a spray non-impact part region, predicting a heat transfer coefficient for each divided region in advance, computing a predicted temperature history of the steel plate based on this predicted value, and setting and controlling amounts of sprayed coolant on the spray impact part regions by top and bottom surface nozzles.

3 Claims, 8 Drawing Sheets

FOREIGN PATENT DOCUMENTS

| | | |
|---|---|---|
| JP | 63-177948 | 11/1988 |
| JP | 02-070018 | 3/1990 |
| JP | 2-16372 | 4/1990 |
| JP | 2-179819 | 7/1990 |
| JP | 02-179819 | 7/1990 |
| JP | 2003-138318 | 5/2003 |
| JP | 2004-1082 | 1/2004 |
| JP | 2006-35311 | 2/2006 |
| JP | 2006-035311 | 2/2006 |

OTHER PUBLICATIONS

H. Xie, et al., "*Numerical Simulation on Hot Strip Temperature Field in Laminar Cooling Process*," Journal of Iron and Steel Research 17(4): 33-36 (2005).

Supplementary European Search Report dated Oct. 17, 2008 issued in corresponding European Application No. 07 79 1716.

(a)

(b)

(a)

(b)

PRIOR ART

METHOD OF COOLING STEEL PLATE

BACKGROUND OF THE INVENTION

1. Field of the Invention

The present invention relates to a method of cooling steel plate applied in order to enable uniform top and bottom cooling in a case of spraying a coolant (cooling medium comprised of water or a mixture of water and air, hereinafter referred to as "cooling water", "coolant", and "water") on the top and bottom surfaces of steel plate (mainly thick-gauge steel plate, hereinafter referred to as "steel plate") with a temperature of several hundreds of degrees or more when constrained and conveyed between a plurality of pairs of constraining rolls in a hot rolling process or a heat treatment process of the steel plate so as to thereby obtain steel plate having uniform shape characteristics and material characteristics and a high quality.

2. Description of the Related Art

For example, a steel plate production facility provided with a process referred to as "controlled cooling" which rapidly cools (acceleratedly cools) high temperature steel plate right after hot rolling by cooling water to obtain a quenching effect and impart high strength characteristics to the steel plate is in practical use.

As the controlled cooling apparatus used here, Japanese Patent Publication (A) No. 61-1420, FIG. 1, etc. discloses the technology of arranging header mechanisms provided with pluralities of nozzles at the top and bottom surface sides of steel plate after hot rolling by a hot finishing mill and spraying cooling water from the groups of top and bottom nozzles to forcibly cool the steel plate.

However, in such a conventional steel plate production facility provided with such a controlled cooling apparatus, there is the problem that when acceleratedly cooling steel plate by the controlled cooling apparatus, shape defects occur due to warping more easily than the conventional case using air cooling due to the unbalance of cooling etc. of the top and bottom surfaces of the steel plate.

These shape defects are mainly caused by the difference of cooling rates due to the difference of behaviors of cooling water sprayed from the top surface side and the bottom surface side of the steel plate or the difference of flows of the cooling water in the plate width direction. Asymmetric internal stresses are generated in the plate thickness direction and the plate width direction causing deterioration of the shape of the product. In remarkable cases, in addition to these shape defects, there sometimes arises the problem of a drop in the mechanical properties such as the strength and elongation of the steel material.

Further, there is also the problem of easy occurrence of variations in quality among products when producing a large number of products having the same specifications. This is mainly due to variations in transformation of the steel material structure due to fluctuations in the cooling stop temperature.

In recent years, tougher restrictions have been placed on uniformity of mechanical properties of steel plate and on variations in production lots when producing products having the same specifications.

At the present, in order to allow variation at the time of cooling and maintain the products at a constant quality or more, variation of the cooling stop temperature is being compensated for by the control of steel ingredients, rolling pattern, etc., by reheat treatment after production, etc. If the variation of the cooling stop temperature is reduced, the economical effects enjoyed become very large, for example, production conditions such as the steel ingredients and rolling pattern can be eased and the heat treatment after production can be omitted.

Further, as technology preventing variation of the cooling stop temperature at the time of cooling the top and bottom surfaces of steel plate to prevent occurrence of shape defects and realizing stability of mechanical properties, conventionally there has been the technology of measuring the temperatures at the top and bottom surfaces of the steel plate at the time of water cooling, predicting the amount of deformation from the temperature difference, and controlling the amounts of water sprayed to the top and bottom surfaces of the steel plate so as to prevent the deformation.

For example, as described in the claim of Japanese Patent Publication (A) No. 2-179819, there is disclosed a cooling control apparatus of hot rolled steel plate having the functions of securing a cooling end temperature previously determined based on the quality of the material and controlling the amounts of cooling water sprayed from the top and bottom surfaces so that the amount of warping of the hot steel plate at the time of the water cooling falls within a prescribed value.

In the technology disclosed in Japanese Patent Publication (A) No. 2-179819, the relationship between the amounts of cooling water and heat transfer coefficients is found in units of the top surface and bottom surface based on various physical properties of the hot steel plate given in advance, the temperature histories in the cooling process in the distribution of temperature in the plate thickness direction are predicted from this relationship, the amount of warping of the hot steel plate is predicted from the temperature distribution histories, and the amounts of cooling water sprayed from the top and bottom surfaces are controlled so that this amount of warping falls within the prescribed range.

In this technology, a cooling zone is formed using the spaces in the conveyance direction between a plurality of pairs of constraining rolls as the control units. In this cooling zone, the amounts of cooling water of the groups of top surface nozzles and the groups of bottom surface nozzles between the pairs of constraining rolls are controlled to the same amounts. A plurality of these cooling zones are arranged to enable adjustment (selective use) of the cooling zones used according to the plate thickness, plate length, and other conditions and the cooling start temperature, cooling stop temperature, and other factors. Then, it is disclosed to control the cooling of the steel plate by changing the amounts of the sprayed water and the conveyance speed. Further, it is disclosed to correct the cooling rate, which differs between mask portions at the end portions and a center portion, in the width direction of the hot steel plate. At this time, as the predicted value of the heat transfer coefficient at the time of cooling used for computation of the temperature histories, the heat transfer coefficient, which changes due to the amounts of the sprayed water and the steel plate temperature as factors, is set in each cooling zone described above.

However, in the technology of Japanese Patent Publication (A) No. 2-179819, for example, as shown FIG. 10, when cooling steel plate 1 being constrained and conveyed between the pairs of constraining rolls $\mathbf{2}_1$ and $\mathbf{2}_2$ in a steel plate cooling region (distance L: about 0.7 m to 1.5 m in usual cases) of a cooling apparatus 6 provided with groups of top and bottom surface nozzles 6*a* and 6*b* each having pluralities of nozzles 3, it is difficult to stably secure precision of cooling control and it is difficult to sufficiently respond to the above-described demands.

According to discoveries by the present inventors, in order to predict the temperature histories of steel plate with a good precision and control the amounts of sprayed coolant in accordance with the prediction with a high precision, it is necessary to sufficiently consider the transition of the heat transfer coefficient as it changes in the steel plate conveyance direction and the steel plate width direction in the steel plate cooling region between pairs of constraining rolls.

However, in the technology of Japanese Patent Publication (A) No. 2-179819, this is not sufficiently considered, therefore the precision of prediction of the heat transfer coefficient becomes insufficient. This is particularly remarkable when changing the conveyance speed in the steel plate conveyance direction.

Accordingly, in the technology of Japanese Patent Publication (A) No. 2-179819, in order to further reduce the difference in temperature histories between the top and bottom surfaces of the steel plate, stably secure the shape characteristics and mechanical characteristics, and secure steel plates able to sufficiently respond to the increasing severe demands for quality, further reinforcement of the cooling control conditions is demanded.

SUMMARY OF THE INVENTION

The present invention, for example as shown FIG. 1, is applied in a case of cooling hot rolled steel plate 1 at both surfaces by spraying coolant from nozzles 3 of groups of top and bottom surface nozzles 6*a* and 6*b* while the plate is being constrained and conveyed between pairs of constraining rolls (for example, between $\mathbf{2}_1$ and $\mathbf{2}_2$) arranged in the steel plate conveyance direction and a case of controlled cooling by the top/bottom surface nozzle groups $\mathbf{6}_1$, $\mathbf{6}_2$ . . . $\mathbf{6}_n$ with regions having clearly different heat transfer coefficients, for example, a spray impact part region A and spray non-impact part regions B and C, in the steel plate cooling region (L region) of the groups of top and bottom surface nozzles 6*a* and 6*b* between pairs of constraining rolls.

The "spray impact part region" referred to here is defined as a main cooling part region in which nozzles are densely arranged and in which an impact area ratio of the coolant spray where the coolant spray directly strikes the surface of the steel plate is large.

Further, a "spray non-impact part region" is defined as a region in which there is a flow of the coolant spray, but the coolant spray does not directly strike the steel plate surface.

An object of the present invention is to provide a method of cooling steel plate sufficiently considering the transition of the heat transfer coefficient as it changes in different regions of the steel plate cooling region so as to for example improve the technology of Japanese Patent Publication (A) No. 2-179819 and further strengthening the precision of cooling control, making the difference of temperature histories of the top and bottom surfaces of the steel plate sufficiently small, stably securing the shape characteristics and mechanical characteristics, and able to sufficiently respond to the tougher demands on qualities in recent years.

The method of cooling steel plate of the present invention has the following (1) to (5) as its gist in order to advantageously solve the above-described problems.

(1) A method of controlled cooling of steel plate using a cooling apparatus of steel plate provided with a plurality of pairs of constraining rolls, each comprised of a top roll and a bottom roll, for constraining and conveying hot rolled steel plate and groups of top and bottom surface nozzles having nozzles arranged in one line or a plurality of lines in a steel plate width direction and spraying a cooling medium to the top and bottom surfaces of the steel conveyed between pairs of constraining rolls adjoining each other to the front and back in a conveyance direction, said method of cooling steel plate characterized by dividing a region of the steel plate cooled by the group of top and bottom surface nozzles between a pair of constraining rolls into at least a spray impact part region and spray non-impact part regions, computing predicted temperature histories of the steel plate based on previously predicted heat transfer coefficients of the divided regions, and controlling the amounts of the sprayed cooling medium of the group of top and bottom surface nozzles at the spray impact part region between the pairs of constraining rolls.

(2) A method of cooling steel plate as set forth in (1) characterized by dividing the spray impact part region of the steel plate cooling region of the group of top and bottom surface nozzles between the pair of constraining rolls into two or more regions in a steel plate conveyance direction and controlling the amounts of the sprayed cooling medium of the group of top and bottom surface nozzles in units of those divided regions.

(3) A method of cooling steel plate as set forth in (1) or (2) characterized by dividing at least the spray impact part region of the steel plate cooling region between the pairs of constraining rolls into two side end regions and an inside region of these two side end regions in the steel plate width direction, computing the predicted temperature histories in the steel plate width direction based on previously set heat transfer coefficients of the divided regions, and controlling the amounts of the sprayed cooling medium of the group of top and bottom surface nozzles at the spray impact part region in the steel plate width direction between the pairs of constraining rolls.

(4) A method of cooling steel plate as set forth in (3) characterized by dividing the spray impact part region of the steel plate cooling region of the group of top and bottom surface nozzles between the pair of constraining rolls into two or more regions in the steel plate width direction and controlling the amounts of the sprayed cooling medium of the group of top and bottom surface nozzles in units of these divided regions.

(5) A method of cooling steel plate as set forth in any one of (1) to (4) characterized by finding the actual values of the heat transfer coefficients between a pair of constraining rolls passed from the measured values of the steel plate temperature at the entry side and exit side between the pair of constraining rolls, correcting the heat transfer coefficients at the time of passing between the following pairs of constraining rolls based on the actual values and the measured values of the steel plate temperatures to correct the predicted temperature histories of the steel plate, and controlling the amounts of the sprayed cooling medium of the group of top and bottom surface nozzles at the spray impact part region in the steel plate width direction and steel plate conveyance direction between the pairs of constraining rolls.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

In the present invention, at the time of computing and predicting the temperature histories of the steel plate, by employing a physically suitable method of dividing a steel plate cooling region cooled by top and bottom surface nozzles between pairs of constraining rolls into individual regions having different heat transfer coefficients, high precision temperature prediction becomes possible in the temperature zones where the change of the heat transfer coefficient is large before and after an MHF point.

Due to this, even when eliminating the difference of the cooling start temperatures between a front end portion and a tail end portion in the same steel plate (the tail end portion entering into the cooling facility later, so the temperature being lower) by making the conveyance speed continuously faster at the tail end portion in comparison with the front end portion so as to make the temperature of the steel plate as a whole uniform, easy temperature estimation becomes possible.

The present invention, more specifically, controls the cooling by dividing a steel plate cooling region cooled by the groups of top and bottom surface nozzles between pairs of constraining rolls into a plurality of regions by regions having close heat transfer coefficients (for example, divides them into spray impact part regions and spray non-impact part regions) and predicting in advance the heat-transfer coefficient in each divided region, therefore it is possible to also consider a case of changing the temperature and the conveyance speed and thereby improve the prediction precision of the heat transfer coefficients and the prediction precision of the predicted temperature histories of the steel plate based on the predicted values of the heat transfer coefficients. Due to this, it is possible to stably secure control precision of the cooling and reduce the width of the distribution of the surface temperature of the steel plate to about 20° C.

Further, by controlling the cooling by considering the heat transfer coefficient distribution for the divided regions of the top and bottom of the steel plate, it is possible to reduce the temperature difference between the top and bottom of the steel plate to about 10° C., cool to the target temperature with a good precision, and stably secure steel plates having stable shape characteristics and mechanical properties as a group of steel plates having small differences of mechanical properties for each steel plate. Note that the MHF point will be explained later.

Figure 1:
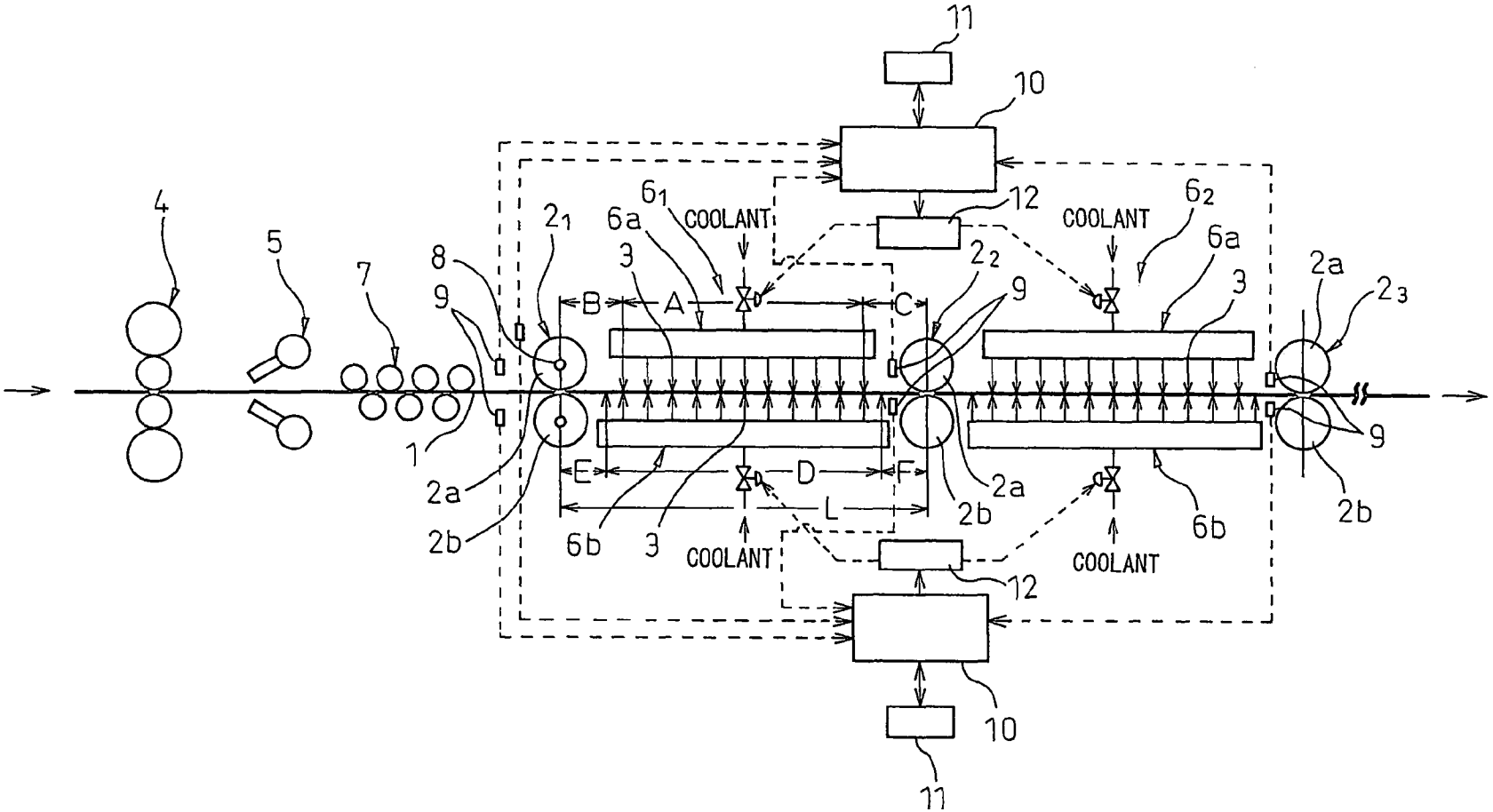
FIG. 1 is a side conceptual explanatory view showing an example of the arrangement of a hot rolling facility provided with a steel plate cooling facility for executing the present invention.

The present inventors, for example as shown FIG. 1, obtained the following discoveries through various experiments for a case of controlled cooling of steel plate 1 by the top/bottom surface nozzle group $\mathbf{6}_1$ (explained using $\mathbf{6}_1$ as representative example here) having a spray impact part region A and spray non-impact part regions B and C in a steel plate cooling region between pairs of constraining rolls.

(1) The heat transfer coefficient with respect to the steel plate 1 greatly differs between the spray impact part region and the spray non-impact part regions of the sprayed coolant in both of the steel plate conveyance direction and steel plate width direction. Namely, the heat transfer coefficient changes according to the ratio of the area occupied by the spray impact surfaces of the sprayed coolant (meaning the area of the surface at which the spray of the sprayed coolant strikes the steel plate surface, hereinafter referred to as the "spray impact area") in a certain region of the steel plate 1.

Accordingly, if for example referring to the case of C the group of nozzles 6*a* on the top surface side in FIG. 1, the heat transfer coefficient clearly differs between the spray impact part region A of the sprayed coolant and the spray non-impact part regions B and C. It also changes according to the depth of the coolant pooled in the region and the spray flow rate and manner of flow of the coolant.

(2) Regarding the spray flow rate of the coolant, when the depth of the coolant pool reaches a certain height, the frequency of the coolant passing through the coolant pool and striking the steel plate is reduced and the heat transfer coefficient is lowered.

(3) The heat transfer coefficient changes according to the surface temperature of the steel plate 1, therefore the temperature falls in the steel plate conveyance direction, so prediction of the heat transfer coefficient considering this is necessary.

(4) When using a coolant including water, the minimum heat flux point (MHF point) observed in a boiling phenomenon clearly differs between the spray impact part region and the spray non-impact part regions.

(5) According to the change in the conveyance speed, the temperature history of the steel plate by the above-described cooling, which exerts an influence upon the stability of the steel plate quality, changes.

From the above-described discoveries, in order to predict the temperature histories of the steel plate with a good precision and control the amounts of sprayed coolant in accordance with the prediction with a high precision, it is necessary to sufficiently consider the transition of the heat transfer coefficient, as it changes in the steel plate conveyance direction and the steel plate width direction, in a steel plate cooling region between pairs of constraining rolls.

The present invention, from the above-described discoveries, basically divides a steel plate cooling region of a group of top/bottom surface nozzles between pairs of constraining rolls into a plurality of regions (divides it into at least a spray impact part region and spray non-impact part regions having clearly different heat transfer coefficients) and controls the cooling considering the transition of the heat transfer coefficient in the steel plate conveyance direction and width direction. Namely, it predicts the heat transfer coefficient for each divided region in advance and improves the prediction precision of the predicted temperature histories of the steel plate based on the predicted values of the transfer coefficients. By this, even when changing the temperature or the conveyance speed, precision of control of the cooling can be stably secured, and steel plates having stable shape characteristics and mechanical properties are stably secured as a group of steel plates having small differences of mechanical properties of individual steel plates.

The heat transfer coefficient of each divided region in the present invention is computed and predicted by considering the cooling facility conditions (the spray impact area determined by the arrangement of the nozzles, coolant depth, spray flow rate, manner of flow, minimum heat flux points), steel plate conditions (steel type and plate thickness and other sizes), cooling operation conditions (temperature, cooling rate, cooling target temperature, conveyance speed), and so on.

Further, the predicted temperature histories based on the predicted values of the heat transfer coefficients for the divided regions and amounts of sprayed coolant based on the predicted temperature histories are obtained by computation based on experiments and numerical computation.

Below, the present invention will be explained more specifically.

First, the relationships between the heat transfer coefficient and the steel plate surface temperature for each cooling region and the heat transfer coefficient, the surface temperature, the sprayed coolant density (water density), and the cooling characteristics, obtained based on the computation of paragraph [0012] by the method of cooling steel plate by top/bottom surface nozzle groups 6 between pairs of constraining rolls as shown in FIG. 1 will be explained with reference to FIG. 6, FIG. 7, and FIG. 8.

Figure 6:
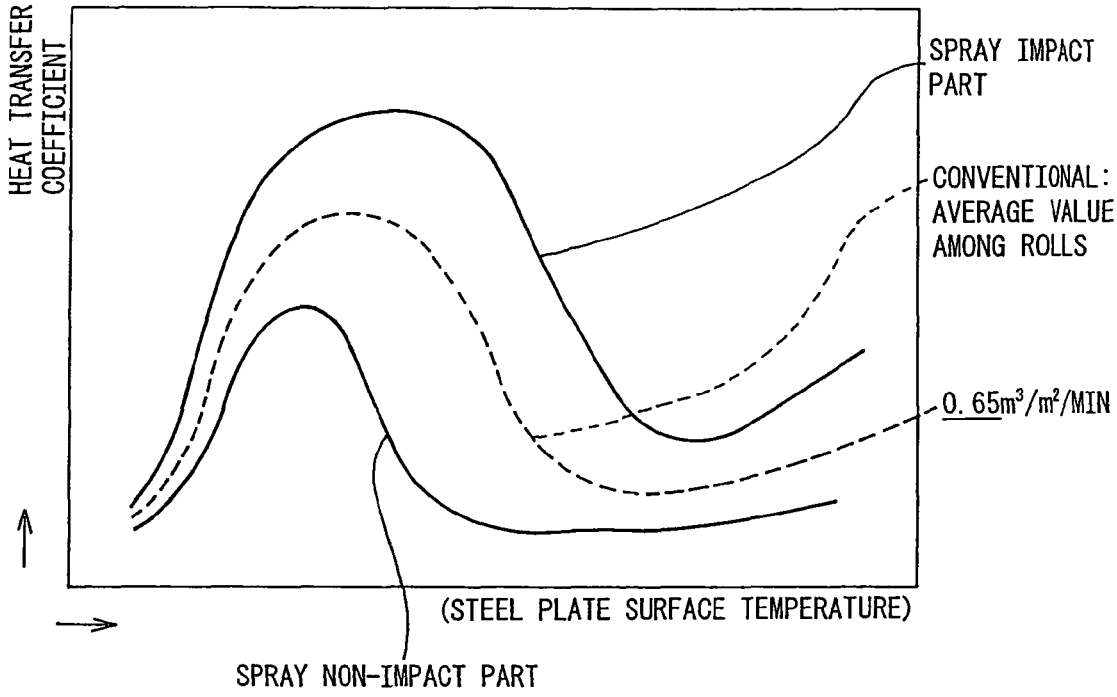
FIG. 6 is an explanatory view of heat transfer coefficients in three classes of spray impact parts (regions), spray non-impact parts (regions), and an average value (conventional) shown by the relationship of the steel plate surface temperature and heat transfer coefficient of a steel plate cooling region between pairs of constraining rolls.

FIG. 6 conceptually shows the relationships of the steel plate surface temperature and the heat transfer coefficient in three sections of the spray impact part (region), spray non-impact parts (regions), and the conventional average value between pairs of constraining rolls in a steel plate cooling region between pairs of constraining rolls (example of the top surface side here). In this figure, the temperature at which the heat transfer coefficient abruptly becomes large when cooling steel plate from a high temperature is called the MHF (minimum heat flux) point. This FIG. 6 shows the fact that the MHF point of the spray impact part region becomes a higher temperature than the MHF points of the spray non-impact part regions and, at the same time, the heat transfer coefficient becomes higher.

Figure 7:
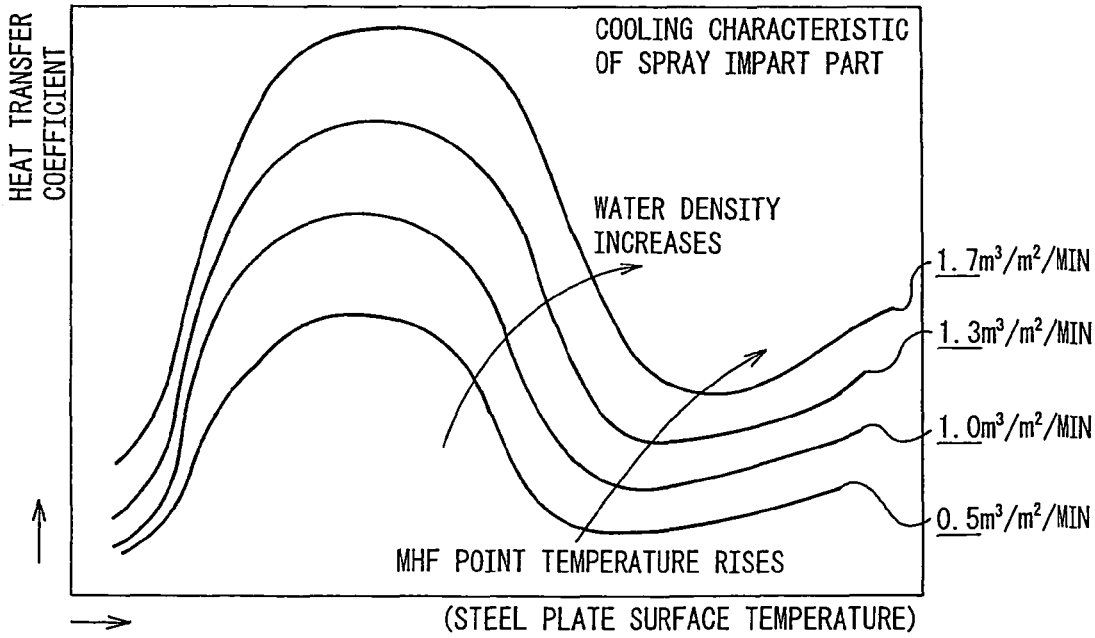
FIG. 7 is an explanatory view of the cooling characteristic of spray impact parts shown by the relationship of the steel plate surface temperature and heat transfer coefficient of a steel plate cooling region between pairs of constraining rolls and the relationship of an increase of water density and increase of MHF points.

Further, FIG. 7 shows the relationship of the steel plate surface temperature and the heat transfer coefficient of the spray impact part (region) in a steel plate cooling region between pairs of constraining rolls (common to top and bottom surface sides here). FIG. 7 shows the fact that the MHF point temperature becomes higher along with the increase of the amount of the sprayed coolant in the spray impact part region and also the heat transfer coefficient in each temperature zone becomes higher.

Figure 8:
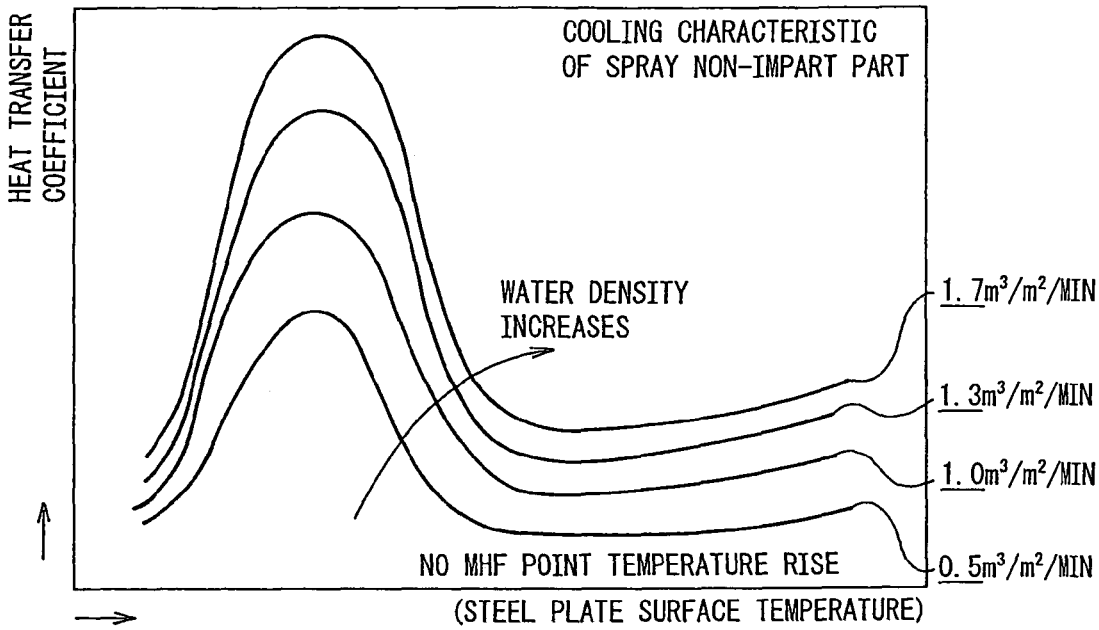
FIG. 8 is an explanatory view of the cooling characteristic of the spray non-impact parts shown by the relationship of the steel plate surface temperature and the heat transfer coefficient between pairs of constraining rolls and the relationship of an increase of water density and increase of MHF points.

FIG. 8 conceptually shows the relationship of the steel plate surface temperature and the heat transfer coefficient in the steel plate cooling region between the pairs of constraining rolls (example of the top surface side here). FIG. 8 shows the fact that the heat transfer coefficient in each temperature zone increases when the amount of sprayed coolant increases in the spray non-impact part regions, but the change of the MHF point temperature is not conspicuous.

In the conventional setting and control of the amounts of sprayed coolant, in general, as indicated by the broken line in FIG. 6, the amounts are predicted and set based on the heat transfer coefficient predicted all together (averaged) in the cooling zone using a plurality of groups of top and bottom surface nozzles between pairs of constraining rolls as a control unit. However, as mentioned above, the cooling characteristic in the case of using water as the coolant depends upon not only the surface temperature of the steel plate, but also how the cooling water is applied and considerably largely fluctuates.

For this reason, when predicting and setting the spray conditions of the cooling water all together in the unit of an individual cooling apparatus, the precision of the cooling control largely differs from the case when predicting and setting the conditions by finely dividing the regions into small portions.

Further, when the conveyance speed of the steel plate changes, the way the cooling water is applied also changes, therefore a sum of the steel plate heat transfer coefficients of the regions of the spray impact part region and the spray non-impact part regions changes and often a discrepancy arises compared with the case of handling the regions all together as in the conventional case. This means that in the case of handling the regions all together as in the conventional case, the setting error often becomes larger.

Figure 9:
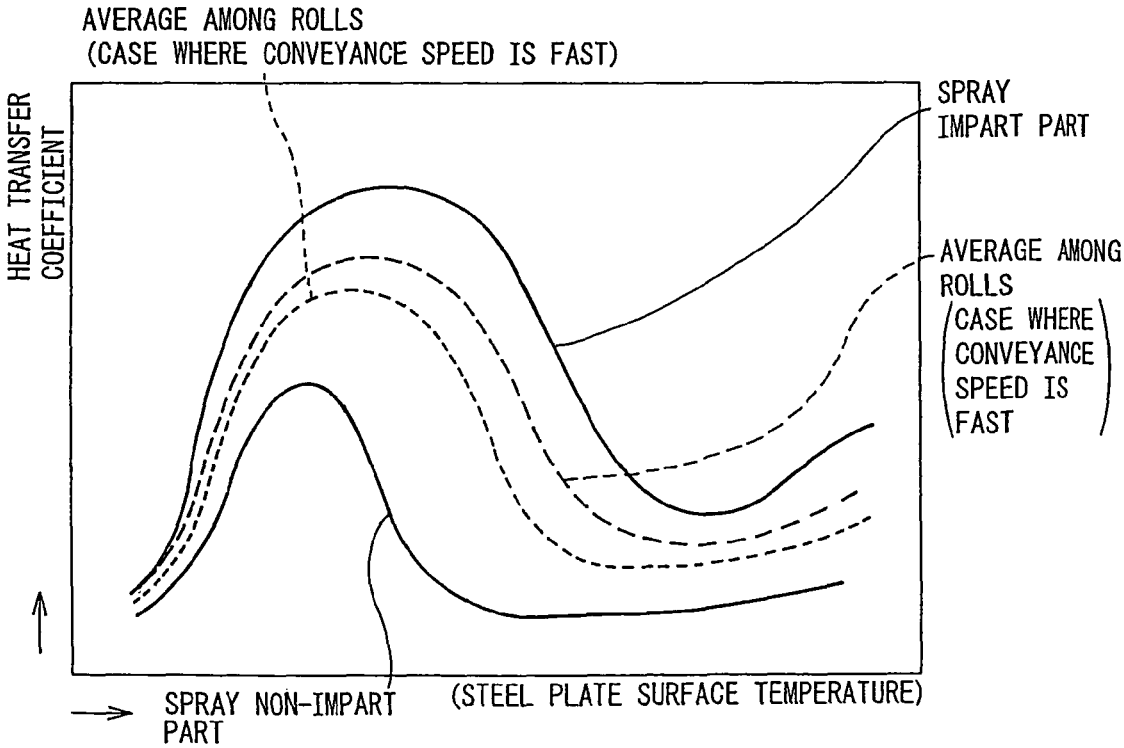
FIG. 9 is an explanatory view showing a change of the average value (conventional) in a case where a conveyance speed of the steel plate changes in FIG. 6.
Figure 10:
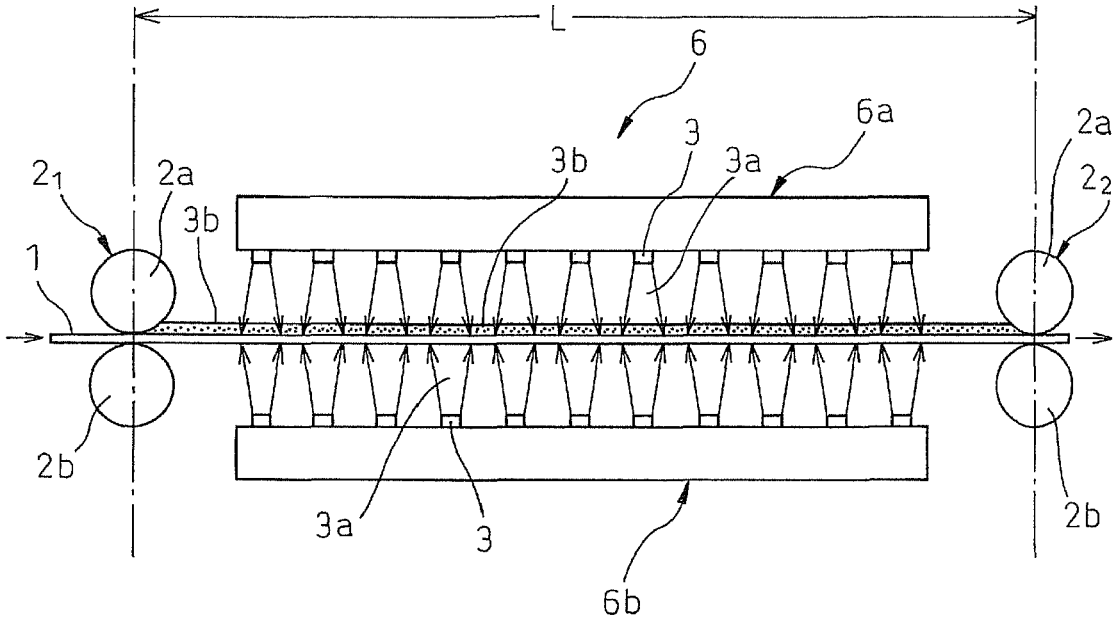
FIG. 10 is a side conceptual explanatory view at the center portion in the width direction showing an example of arrangement of nozzles at groups of top and bottom surface nozzles in a top/bottom surface nozzle group between pairs of constraining rolls of conventional steel plate.

Namely, as shown FIG. 9 showing the change of the heat transfer coefficient when the conveyance speed changes in the case of FIG. 6, in a case where the conveyance speed is fast, the residence time at each instance in the spray impact part region is short and the average heat transfer coefficient becomes as shown by the broken line, but in a case where the conveyance speed is slow, the residence time at each instance in the spray impact part region is long and the MHF point is easily reached, therefore the average heat transfer coefficient becomes as indicated by the one dot chain line. This change is conspicuous in the case where the amount of sprayed coolant is large. It might be considered from this fact that it would be sufficient to determine the coolant characteristic averaged for each conveyance speed, but when the plate thickness increases, the steel plate becomes harder to cool etc. In order to properly set the cooling conditions required for the control of the quality of material of the steel plate, it is necessary to increase the parameter of the cooling characteristic for each cooling condition such as the plate thickness and cooling stop temperature, so the settings become complex.

The present invention was made by sufficiently considering the discoveries and experimental results of the present inventors described above. Basically, the present invention relates to controlled cooling of steel plate by using a cooling facility of steel plate provided with a plurality of pairs of constraining rolls, each comprised of a top roll and a bottom roll, for constraining and conveying for example hot rolled steel plate and groups of top and bottom surface nozzles having nozzles arranged in one line or a plurality of lines in the steel plate width direction for spraying coolant on the top and bottom surfaces of the steel plate passing between pairs of constraining rolls adjoining each other in front and back in the conveyance direction.

The present invention considers the fact that there are portions where the heat transfer coefficients with the steel plate are clearly different in the steel plate conveyance direction and width direction in each steel plate cooling region between the plurality of pairs of constraining rolls (for example, the spray impact part region and the spray non-impact part regions) and for example divides the region into these portions (regions) to set the optimum cooling control conditions for raising the prediction precision of the heat transfer coefficients and raising the prediction precision of the temperature histories of the steel plate. Due to this, even when changing the conveyance speed, the precision of cooling control from the start of cooling to the end of cooling is stably secured and the steel plate is uniformly cooled with a good precision down to the target temperature. Due to this, the present invention realizes a method of cooling steel plate able to stably secure the steel plate quality.

[Example Of Cooling Facility]

In the present invention, conceptually, for example, as shown in the example of the layout of a steel plate production facility of FIG. 1, use is made of a cooling facility arranged at a rear stage of a hot rolling mill 4 and provided with a plurality of top/bottom surface nozzle groups $\mathbf{6}_1$, $\mathbf{6}_2$ . . . $\mathbf{6}_n$ . . . , each comprised of groups of top and bottom surface nozzles 6*a* and 6*b* having pluralities of nozzles 3 able to be controlled in amounts of sprayed coolant, between a plurality of pairs of constraining rolls $\mathbf{2}_1$ and $\mathbf{2}_2$, $\mathbf{2}_2$ and $\mathbf{2}_3$ . . . $\mathbf{2}_{n-1}$ and $\mathbf{2}_n$ . . . , each comprised of top and bottom rolls 2*a* and 2*b*.

This cooling facility has regions having clearly different heat transfer coefficients in the steel plate conveyance direction in each steel plate cooling region of the groups of top and bottom surface nozzles 6*a* and 6*b* of the top/bottom surface nozzle groups $\mathbf{6}_1$, $\mathbf{6}_2$ . . . $\mathbf{6}_n$ . . . between pairs of constraining rolls (distance L between pairs of constraining rolls $\mathbf{2}_1$ and $\mathbf{2}_2$×width region of steel plate 1), for example, the spray impact part region A of the coolant and the spray non-impact part regions B and C at the top surface side and the spray impact part region D of the coolant and the spray non-impact part regions E and F at the bottom surface side.

When using this cooling facility to work the present invention, the top/bottom nozzle groups between the pairs of constraining rolls for handling the cooling are selected in advance in accordance with the size and temperature of the steel plate 1 from the hot rolling mill 4 and the cooling speed, cooling target temperature, conveyance speed, etc. for obtaining the desired characteristics. Steel plate 1 having a temperature of 700 to 950° C. being constrained and conveyed between the pairs of constraining rolls is cooled at the two surfaces to cool it to the cooling target temperature of a range from room temperature to 700° C.

This cooling facility is provided with a conveyance speed meter 8 and thermometers 9 and can obtain conveyance speed information and temperature information.

The present invention predicts the heat transfer coefficient of each divided region of a steel plate cooling region, computes and predicts the predicted temperature histories of the steel plate down to the cooling target temperature, and sets and controls the amounts of coolant spray. For this purpose, a cooling control apparatus comprised of a computer 10 for performing various computations, a setting unit 11 for setting various computation conditions required for the above computations (settings, computation equations, etc.), and a coolant controller 12 for controlling the amounts of coolant spray of the spray impact part regions is connected.

Figure 4:
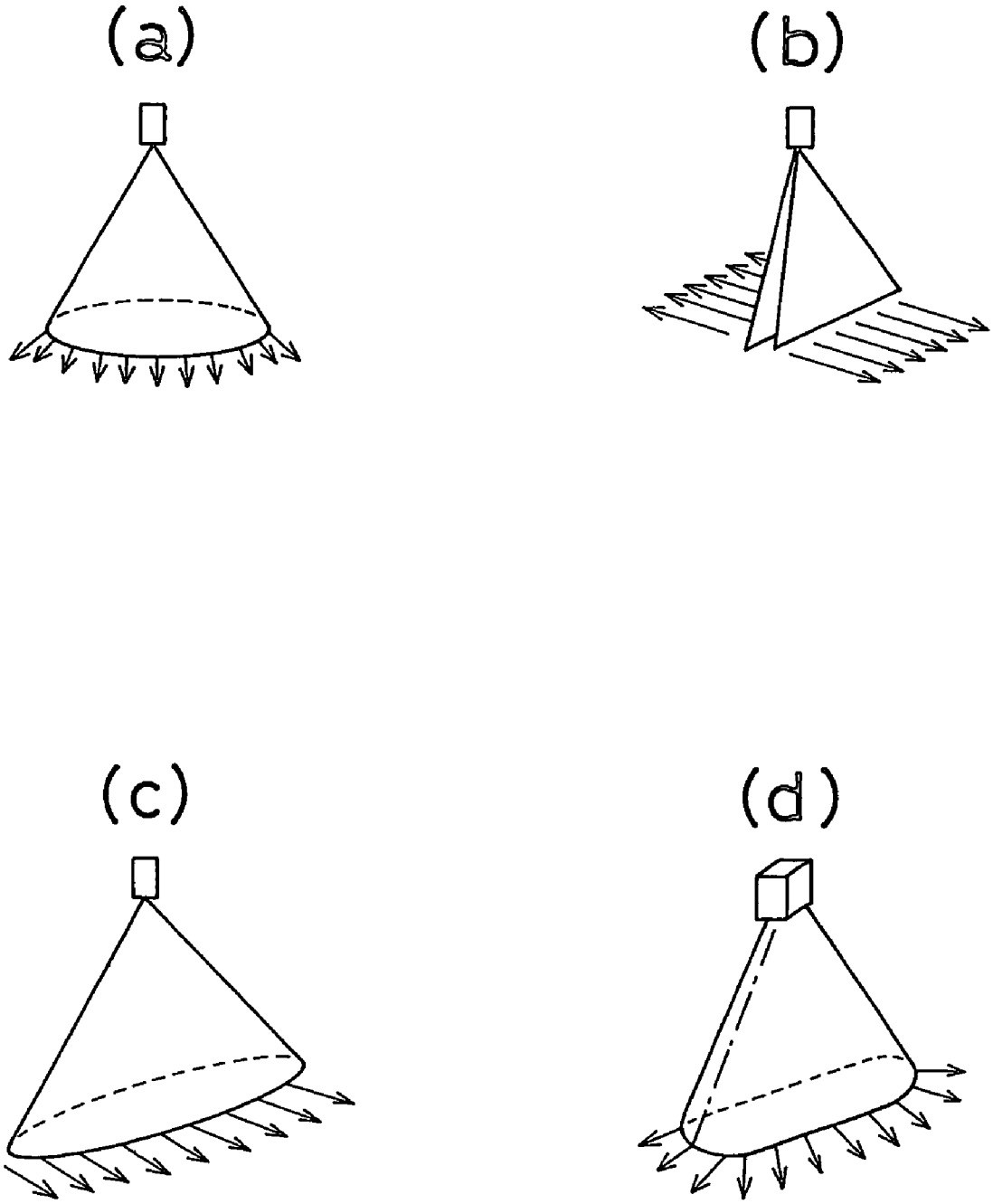
FIG. 4 gives 3D explanatory views showing examples of nozzles used in the present invention.

In this cooling facility, as the nozzles 3 forming the groups of top and bottom surface nozzles 6*a* and 6*b*, for example, generally used nozzles as shown in FIG. 4 such as full cone spray nozzles, oval or oblong spray nozzles, and flat spray nozzles which have coolant sprays spreading outward and can form impact areas larger than the calibers of the nozzles on the surface of the steel plate 1 are mainly used, but slit nozzles, columnar nozzles, laminar nozzles, and other nozzles are also included. Note that, in FIG. 1, 5 is a deskilling device, and 7 is a straightener.

[Example 1 of Division of Regions]

In the present invention according to the example of the cooling facility of FIG. 1, in order to improve the precision of cooling control, a steel plate cooling region of a top/bottom surface nozzle group between pairs of constraining rolls is divided into a plurality of regions of at least the spray impact part region A of the coolant and the spray non-impact part regions B and C of the steel plate conveyance direction at the top surface side. Further, the region is divided into a plurality of regions of at least the spray impact part region D of the coolant and the spray non-impact part regions E and F at the bottom surface side.

The heat transfer coefficient in each divided region is predicted in advance by experiments, heat computation, etc., the temperature histories of the top and bottom surfaces of the steel plate 1 are computed based on the predicted values, and the amounts of sprayed coolant for making the temperature histories for the top and bottom surfaces of the steel plate from the start of cooling to the end of cooling approach each other are set and controlled.

Further, in the steel plate width direction of a steel plate cooling region of a top/bottom surface nozzle group between pairs of constraining rolls, although not shown, there are regions having different heat transfer coefficients, for example, a spray impact part region (width center region) and spray non-impact part regions (when there is a mask portion) or spray impact part regions (where there is no mask portion) on the two sides of that, therefore the region is divided into these regions. Further, division of regions is considered based on the difference of the manner of flow of the coolant.

Further, the heat transfer coefficients in the divided regions are predicted in advance and the temperature histories of the top and bottom surfaces of the steel plate are computed based on these predicted values. By combining the results of computation with the heat transfer coefficient and temperature history of each divided region in the steel plate conveyance direction described above, it is possible to set and control the amounts of sprayed coolant for making the temperature histories of the top and bottom surfaces of the steel plate from the start of cooling to the end of cooling considering both the steel plate conveyance direction and the steel plate width direction approach each other.

Note that in order to improve the precision of cooling control according to the present invention in the above cooling facility, it can be considered to divide for example the spray impact part regions A and D into two or more regions in the steel plate conveyance direction in a steel plate cooling region of the groups of top and bottom surface nozzles 6*a* and 6*b* of each of the top/bottom surface nozzle groups $\mathbf{6}_1$, $\mathbf{6}_2$ . . . $\mathbf{6}_n$ . . . between pairs of constraining rolls. In this case, it may be considered to control the amounts of sprayed coolant in units of these divided regions.

[Example 2 of Division of Regions]

The case of using the steel plate cooling method of the present invention to cool steel plate 1 by coolant sprays 3*a* using water as a coolant (hereinafter also referred to as "water" or "cooling water") will be explained in further detail based on FIG. 2 and FIG. 3—which are conceptual views of principal portions showing enlarged an example of the top/bottom surface nozzle group $\mathbf{6}_1$ arranged between the pairs of constraining rolls $\mathbf{2}_1$ and $\mathbf{2}_2$ shown in FIG. 1.

Here, a structure dividing the spray impact part regions A and D of the groups of top and bottom surface nozzles into two regions respectively in the steel plate conveyance direction, predicting the heat transfer coefficient for each of the divided regions including other divided regions, and separately setting and controlling the amounts of spray cooling in the divided regions will be shown.

Figure 2:
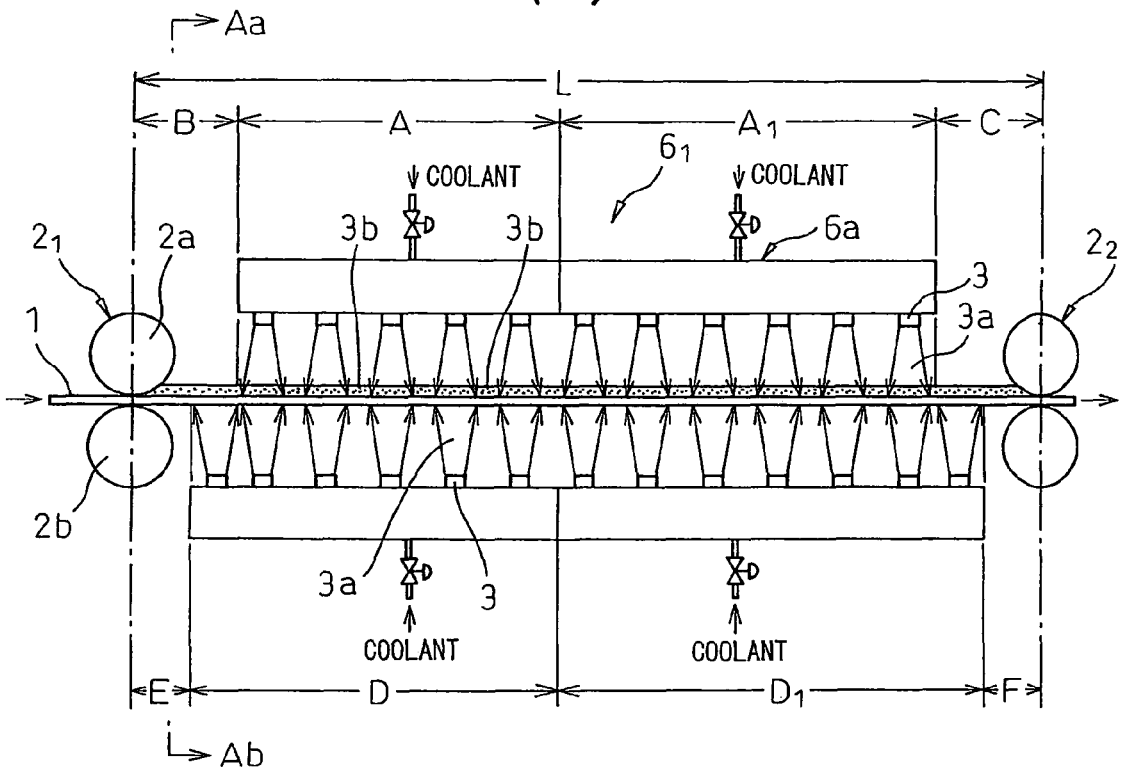
FIG. 2(*a*) is a side conceptual explanatory view at a center portion in a width direction showing an example of arrangement of nozzles in the conveyance direction at a top/bottom surface nozzle group between pairs of constraining rolls in the cooling facility of FIG. 1 and an example of division of a steel plate cooling region, and FIG. 2(*b*) is a conceptual explanatory view taken along an arrow Aa-Ab of FIG. 2(*a*)
Figure 2:
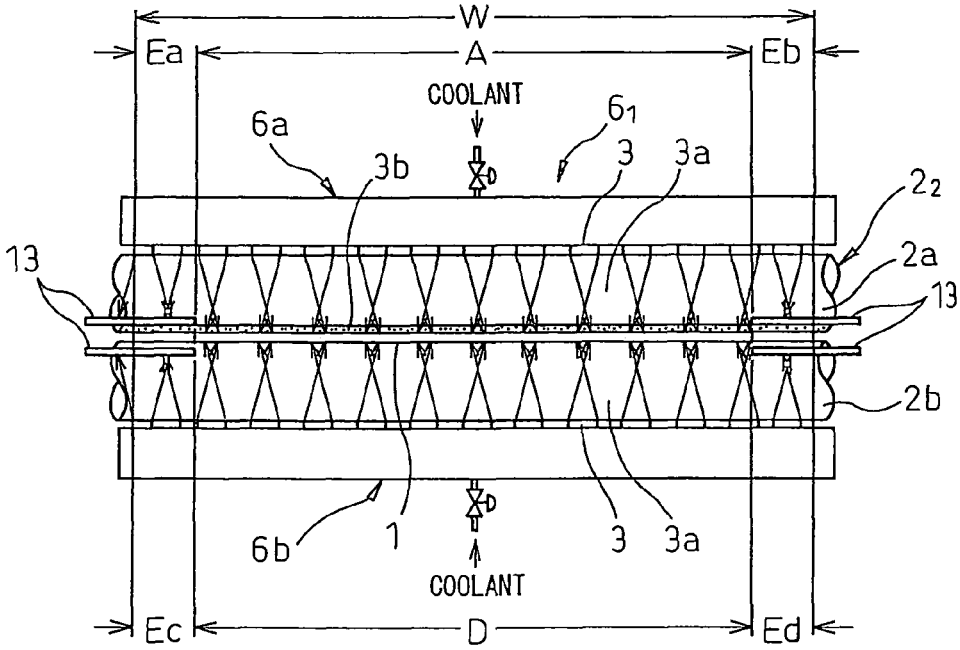

FIG. 2(*a*) shows an example of division of the steel plate cooling region L between the pairs of constraining rolls $\mathbf{2}_1$ and $\mathbf{2}_2$ in the example of arrangement of nozzles 3 in the steel plate conveyance direction by the groups of top and bottom surface nozzles 6*a* and 6*b* provided with pluralities of nozzles 3. Here, the nozzles 3 are oval spray nozzles as shown FIG. 4(*c*), and the spray impact surfaces are oval types. The nozzles are arranged so that their long axis sides cross the conveyance direction. They are arranged in a plurality of lines at fixed intervals in the conveyance direction so as to make the coolant sprays 3*a* strike the surface of the steel plate 1 from substantially right angle directions.

FIG. 2(*b*) shows the arrangement of nozzles 3 in the steel plate width direction by the groups of top and bottom surface nozzles 6*a* and 6*b* and an example of the division of the steel plate cooling region L between the pairs of constraining rolls $\mathbf{2}_1$ and $\mathbf{2}_2$.

The coolant sprays 3*a* sprayed to the top surface side of the steel plate cool the top surface of the steel plate 1 and are discharged from the side ends of the steel plate 1 as a plate top coolant flow 3*b*. Further, the coolant sprays 3*a* sprayed to the bottom surface side of the steel plate strike the bottom surface of the steel plate 1, cool the bottom surface of the steel plate 1, then fall and are discharged.

In FIG. 2(*b*), 13 are edge masks for forming mask portions for blocking the coolant sprays 3*a* to prevent them from striking the two side portions of the steel plate 1.

Figure 3:
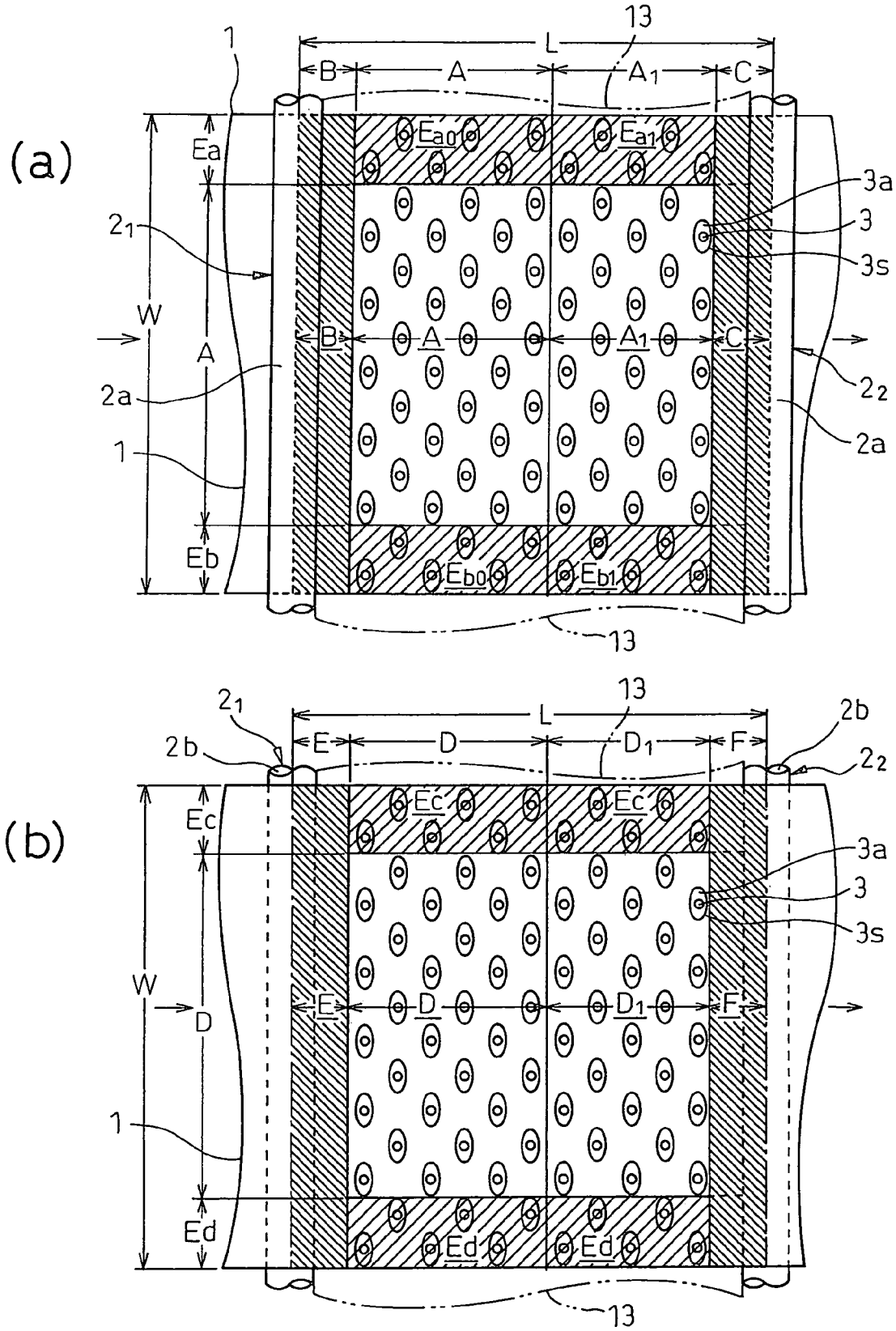
FIG. 3(*a*) is a plan conceptual explanatory view showing an example of arrangement of nozzles at a group of top surface nozzles in FIG. 2(*a*) and an example of division of the steel plate cooling region, and FIG. 3(*b*) is a plan conceptual explanatory diagram of the steel plate bottom surface side showing an example of arrangement of nozzles at a groups of bottom surface nozzles in FIG. 2(*a*) and an example of division of the steel plate cooling region.

FIG. 3(*a*) is a plan conceptual view showing an example of the arrangement of nozzles 3 and divided regions in a steel plate cooling region in the steel plate width direction and the steel plate conveyance direction of the group of top surface nozzles 6*a* of the top/bottom surface nozzle group $\mathbf{6}_1$ between the pairs of constraining rolls $\mathbf{2}_1$ and $\mathbf{2}_2$ of FIG. 2(*a*).

FIG. 3(*b*) is a plan conceptual view seen from the bottom surface side of the steel plate 1 showing an example of the arrangement of nozzles 3 and divided regions in a steel plate cooling region in the steel plate width direction and the steel plate conveyance direction of the group of bottom surface nozzles 6*b* of the top/bottom surface nozzle group $\mathbf{6}_1$ between the pairs of constraining rolls $\mathbf{2}_1$ and $\mathbf{2}_2$ of FIG. 2(*a*).

In Example 2 of the Division of Regions, as shown in FIG. 2(*a*), the steel plate cooling region of the top/bottom surface nozzle group $\mathbf{6}_1$ arranged between the pairs of constraining rolls $\mathbf{2}_1$ and $\mathbf{2}_s$ for example is divided in the steel plate conveyance direction on the top surface side into:

(1) the spray impact part region A, (2) the spray impact part region $A_1$, (3) the spray non-impact part region B in the region in the vicinity of the constraining rolls $\mathbf{2}_1$, and (4) the spray non-impact part region C in the region in the vicinity of the constraining rolls $\mathbf{2}_2$.

In the division of the top surface side in the conveyance direction, the heat transfer coefficients of the divided regions are previously predicted, the predicted temperature history from the start of cooling to the end of cooling on the top surface side of the steel plate 1 between the pair of constraining rolls is computed based on these predicted values, and the amounts of sprayed coolant in the spray impact part regions A and $A_1$ on the top surface of the steel plate from the start of cooling to the end of cooling by the groups of top and bottom surface nozzles 6*a* and 6*b* are set and controlled.

Here, the steel plate cooling region was divided into four regions, but further finer division of regions based on the temperature drop in the conveyance direction or the difference of manners of flow of the coolant can also be considered. Further, the steel plate cooling region can also be divided into just the two regions of the spray impact part region A and the spray non-impact part regions (B, C).

Further, on the bottom surface side, the cooling region is divided in the steel plate conveyance direction into:

(1) the spray impact part region D substantially facing the spray impact part region A on the top surface side, (2) the spray impact part region $D_1$ substantially facing the spray impact part region $A_1$ on the top surface side, (3) the spray non-impact part region E substantially facing the spray non-impact part region B on the top surface side, and (4) the spray non-impact part region F substantially facing the spray non-impact part region C on the top surface side.

In this division of the bottom surface side in the conveyance direction as well, the heat transfer coefficients are predicted in units of the divided regions based on the size, temperature, and relationship between the temperature and the heat transfer coefficient of the steel plate 1, the cooling target temperature, conveyance speed, cooling rate, spray impact area ratio, and so on, the predicted temperature history from the start of cooling to the end of cooling of the steel plate bottom surface side between this pair of constraining rolls is computed based on the predicted values, and the amount of sprayed coolant of each divided region is set and controlled so that the temperature history of this steel plate bottom surface side approaches the temperature history of the steel plate top surface side facing this. Here, the steel plate cooling region was divided into four regions, but further division of regions based on the temperature drop in the conveyance direction or the difference of manners of flow of the coolant can also be considered.

Note that the coolant sprays of the group of bottom surface nozzles does not cause almost any coolant flow on the steel plate surface as in the case of the group of top surface nozzles, therefore by forming for example the spray impact part region wide corresponding to the heat transfer coefficients of the divided regions of the group of top surface nozzles, the influence of any change of the conveyance speed can be made smaller in comparison with the case of the group of top surface nozzles (corresponding to the aspect of claim 1).

On the other hand, in the steel plate width direction of the top surface side of the top/bottom surface nozzle group $\mathbf{6}_1$ between the pairs of constraining rolls, as shown FIG. 2(*b*), the steel plate cooling region (width w region of the steel plate 1) is divided into:

(1) the spray impact part region A of the center region (A on the upstream side and $A_1$ on the downstream side), (2) the spray non-impact part region of one side end (mask portion region) Ea ($Ea_0$ on the upstream side and $Ea_1$ on the downstream side), and (3) the spray non-impact part region of the other side end (mask portion region) Eb ($Eb_0$ on the upstream side and $Eb_1$ on the downstream side).

In the division of the top surface side in the steel plate width direction, the region is divided to lines of the divided regions A ($A_1$), Ea, and Eb in the steel plate width direction, heat transfer coefficients in the A, $A_1$, B, and C regions in the steel plate conveyance direction are predicted, the steel plate temperature history is computed based on these predicted values, and the amounts of sprayed coolant in the spray impact part regions A, $A_1$, Ea, and Eb are set and controlled (the amounts of sprayed coolant are sometimes set and controlled by defining the Ea and Eb regions as the spray impart part regions when they are not mask portion regions).

Further, in the steel plate width direction on the bottom surface side of the top/bottom surface nozzle group $\mathbf{6}_1$ between the pairs of constraining rolls, in the same way as the top surface side, the steel plate cooling region is divided into:

(1) the spray impact part region of the center region (D on the upstream side, and $D_1$ on the downstream side), (2) the spray non-impact part region of one side end (mask portion region) Ec, and (3) the spray non-impact part region of the other side end (mask portion region) Ed.

In the division of the bottom surface side in the steel plate width direction, the region is divided into the lines of the divided regions D ($D_1$), Ec, and Ed in the steel plate width direction, heat transfer coefficients in the D, $D_1$, E, and F regions in the steel plate conveyance direction are predicted, the predicted temperature history of the steel plate from the start of cooling to the end of cooling between this pair of constraining rolls is computed based on these predicted values, and amounts of sprayed coolant of the spray impact part regions D or $D_1$, Ec, and Ed are set and controlled so as to approach the predicted temperature history of the steel plate in the divided regions facing the divided lines of the group of top surface nozzles 6*a* (where the Ec and Ed regions are not the mask portion regions, the amounts of sprayed coolant are sometimes set and controlled by defining these as the spray impact part regions).

In this way, when considering the heat transfer coefficients of the divided regions in the steel plate conveyance direction and the steel plate width direction, it is possible to further stably raise the precision of cooling control more than the case of considering only the heat transfer coefficients in the steel plate conveyance direction (corresponding to the aspect of claim 3).

In order to more stably secure the above-described precision of cooling control, for example, it would be effective to also consider dividing the spray impact part regions of the groups of top and bottom surface nozzles 6*a* and 6*b* of the top/bottom nozzle groups $\mathbf{6}_1$ and $\mathbf{6}_2$ between the pairs of constraining rolls $\mathbf{2}_1$ and $\mathbf{2}_2$ and between the pairs of constraining rolls $\mathbf{2}_2$ and $\mathbf{2}_3$ into pluralities of regions in the steel plate conveyance direction and the steel plate width direction, predicting the heat transfer coefficients in units of divided regions, computing the predicted temperature histories of the steel plate, and setting and controlling the amounts of sprayed coolant (corresponding to the aspects of claim 2 and claim 4).

In general, in the actual operation at a cooling facility, sometimes the predicted temperature histories of the steel plate in the above-described divided regions do not become as predicted due to the fluctuations of the size of the steel plate, conveyance speed, temperature, etc., so the precision of cooling control is lowered, the top and bottom surfaces of the steel plate 1 cannot be uniformly cooled down to the target temperature with a good precision, and the steel plate quality becomes unable to be stably secured.

As a countermeasure for this, more preferably the conveyance speed and the temperatures on the entry side and exit side of the top/bottom surface nozzle groups $\mathbf{6}_1, \mathbf{6}_2 \ldots \mathbf{6}_n \ldots$ between the pairs of the constraining rolls $\mathbf{2}_1$ and $\mathbf{2}_2$, $\mathbf{2}_2$ and $\mathbf{2}_3, \ldots \mathbf{2}_{n-1}$ and $\mathbf{2}_n \ldots$ are actually measured, the actual heat transfer coefficients in the top/bottom surface nozzle groups between specific pairs of constraining rolls and the following pairs are computed, the predicted temperature histories of the steel plate by the top/bottom surface nozzle groups between the specific pairs of constraining rolls and the following pairs are corrected based on these computed values, and setting and control corresponding to actual operation can be changed to (corresponding to the aspect of claim 5).

In the present invention, dividing a steel plate cooling region into at least a spray impact part region and spray non-impact part regions in the steel plate conveyance direction and predicting the heat transfer coefficient for each divided region is a requirement. In the steel plate width direction, the manner of flow of the coolant, particularly the coolant depth, differs between the center region and the two side regions, therefore the heat transfer coefficients are different, so division of the cooling region in the steel plate width direction is considered.

Dividing the steel plate cooling region in both of the steel plate conveyance direction and the steel plate width direction is not indispensable, but sometimes edge masks 13 are arranged at the two side regions in the steel plate width direction so as to block the coolant sprays 3*a* from the nozzles 3 to prevent them from striking the steel plate. For the purpose of stably securing the precision of cooling control in the width direction at that time as well, it is possible to predict the heat transfer coefficients at the mask portions of the edge masks 13 separately so as to commensurately improve the precision of cooling control. Accordingly, it is preferable to divide the steel plate cooling region in both of the steel plate conveyance direction and steel plate width direction and predict the heat transfer coefficient for each divided region.

Note that, as described above, when dividing a steel plate cooling region by the groups of top and bottom surface nozzles 6*a* and 6*b*, it is not indispensable that the divided regions be exactly the same at the steel plate top surface side and the steel plate bottom surface side.

[Example 3 of Division of Regions]

Figure 5:
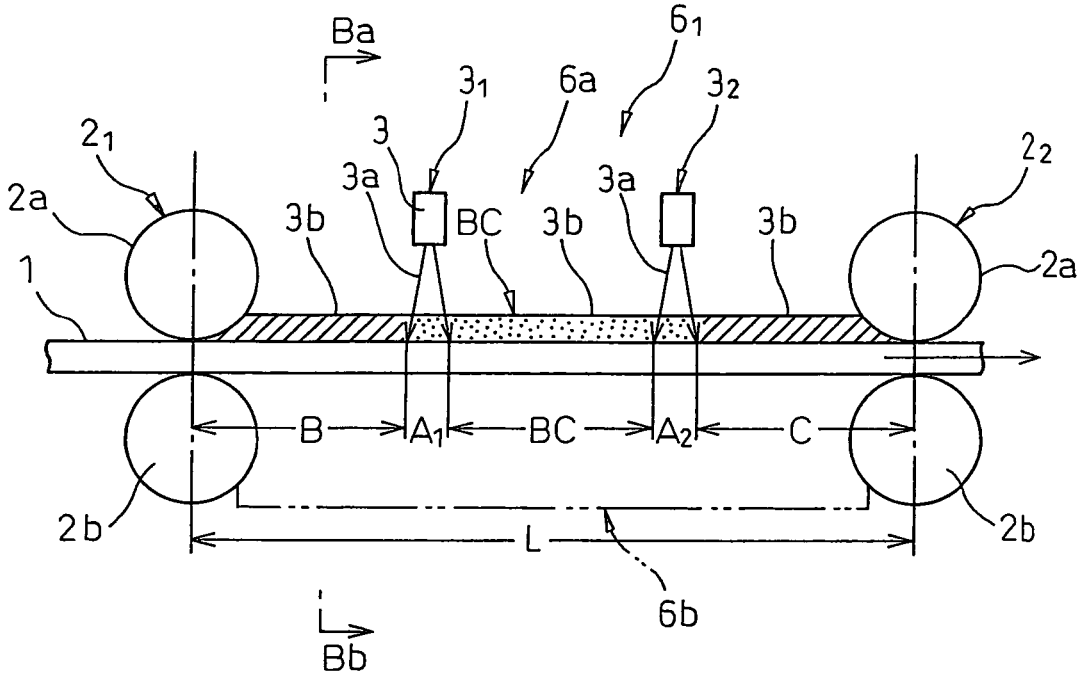
FIG. 5(*a*) is a side conceptual explanatory view at the center portion in the width direction showing another example of a top/bottom surface nozzle group between pairs of constraining rolls and an example of arrangement of nozzles in the conveyance direction of the group of top surface nozzles and an example of division of the steel plate cooling region in the conveyance direction, and FIG. 5(*b*) is a conceptual explanatory view taken along an arrow Ba-Bb of FIG. 5(*a*) showing an example of arrangement of nozzles in the width direction in the group of top surface nozzles in FIG. 2(*a*) and an example of division of the steel plate cooling region in the width direction.
Figure 5:
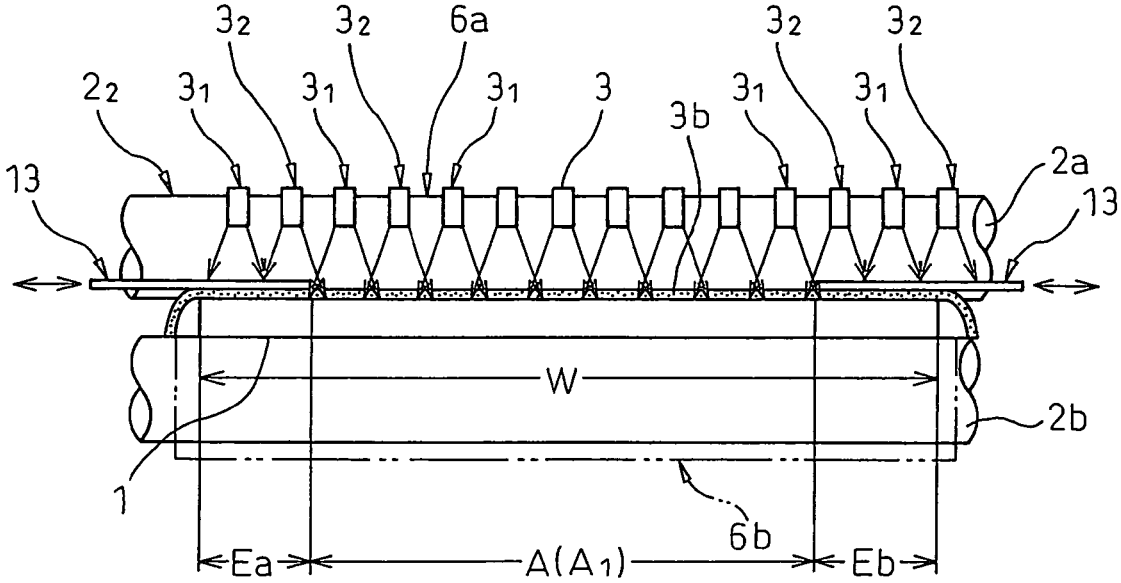

Example 3 of the Division of Regions, as shown FIGS. 5(*a*) and 5(*b*), differs from Examples 1 and 2 of the Division of Regions in the point that the nozzles $\mathbf{3}_1$ (group) and $\mathbf{3}_2$ (group) of the groups of top surface nozzles 6*a* are arranged with respect to the steel plate 1 to be clearly separated in the steel plate conveyance direction.

When applying the present invention, the nozzle $\mathbf{3}_1$ region and $\mathbf{3}_2$ region are defined as the spray impact part regions A and $A_1$, and the space between the nozzle $\mathbf{3}_1$ region and the nozzle $\mathbf{3}_2$ region is treated as a spray non-impact part region BC. Accordingly, in this case, the steel plate cooling region is divided into for example:

(1) the spray impact part region A (2) the spray impact part region $A_1$ (3) the spray non-impact part region B (4) the spray non-impact part region C (5) the spray non-impact part region BC Further, in the top surface nozzle group 6*a* in the steel plate width direction, basically, in the same way as the case of the Example 2 of Division of Regions shown FIG. 2(*b*) and FIG. 3(*b*), it may be considered to divide the steel plate cooling region to Ea, A (or $A_1$), and Eb.

Note that, here, the explanation is omitted for the division of regions of the group of bottom surface nozzles 6*b*.

Regarding the amounts of sprayed coolant from nozzles of the groups of top and bottom surface nozzles 6*a* and 6*b* between the pairs of constraining rolls in the present invention, it is possible to consider the cooling characteristics based on for example experimental values and heat computation, for example, based on relationships of the steel plate surface temperatures and heat transfer coefficients in the spray impact part regions and spray non-impact part regions according to FIG. 7, FIG. 8, etc., water densities, presence/absence of rise of the MHF point, and so on so as to compute, set, and control conditions enabling efficiently realization of uniform cooling at the top and bottom of the steel plate and in the steel plate width direction.

For example, in the group of top surface nozzles, the heat transfer coefficient of each divided region is predicted and set, the temperature history of the steel plate is computed based on the predicted values, and the amounts of sprayed coolant and conveyance speeds of the divided regions (spray impact part regions) in the steel plate conveyance direction and the steel plate width direction from the start of cooling to the end of cooling are set and controlled so as to stably secure a precision of cooling control corresponding to the steel plate conditions (plate thickness, plate width, cooling stop temperature), change on cooling start temperature, and change in conveyance speed.

Further, in the group of bottom surface nozzles, basically, corresponding to the heat transfer coefficient in each divided region of the group of top surface nozzles, the steel plate cooling region is divided into a plurality of regions and the amount of sprayed coolant in each divided region is set and controlled so as to reduce the difference of temperature histories of the top and bottom surfaces of the steel plate.

In the present invention, in this way, the steel plate cooling region of each top/bottom surface nozzle group between pairs of constraining rolls is divided into a plurality of regions, the heat transfer coefficients in the divided regions are predicted with a good precision, the predicted temperature histories of the steel plate are computed, the difference in temperature histories of top and bottom surfaces of the steel plate is made smaller, and the amounts of sprayed coolant and conveyance speed are set and controlled so as to make the steel plate become the cooling target temperature at the top/bottom surface nozzle group between pairs of constraining rolls.

Above, the explanation was given based on the top/bottom surface nozzle group $\mathbf{6}_1$ arranged between the pairs of constraining rolls $\mathbf{2}_1$ and $\mathbf{2}_2$. Following the top/bottom surface nozzle group $\mathbf{6}_1$, top/bottom surface nozzle groups $\mathbf{6}_2 \ldots \mathbf{6}_n \ldots$ between pairs of constraining rolls $\mathbf{2}_2$ and $\mathbf{2}_3 \ldots \mathbf{2}_{n-1}$ and $\mathbf{2}_n \ldots$ similar to the top/bottom surface nozzle group $\mathbf{6}_1$ (where the steel plate temperature level becomes lower the further to the rear the top/bottom surface nozzle group between the pairs of constraining rolls, therefore these top/bottom surface nozzle groups do not always become the same) are arranged in the conveyance direction so as to share the cooling.

In each of the following top/bottom surface nozzle groups $\mathbf{6}_2 \ldots \mathbf{6}_n \ldots$ etc. between the pairs of constraining rolls $\mathbf{2}_2$ and $\mathbf{2}_3 \ldots \mathbf{2}_{n-1}$ and $\mathbf{2}_n \ldots$ as well, basically, in the same way as the top/bottom surface nozzle group $\mathbf{6}_1$ between the pairs of constraining rolls, the steel plate cooling region is divided, the heat transfer coefficient of each divided region is predicted, the predicted temperature history of the steel plate is computed, and the amounts of sprayed coolant of each top/bottom surface nozzle group between the pairs of constraining rolls are set and controlled so as to reduce the temperature history difference of the steel plate in the top/bottom direction and width direction of the steel plate and obtain the cooling target temperature when ending the cooling at the last top/bottom surface nozzle group between the pairs of constraining rolls

EXAMPLE

This Example is an example of the cooling facility of steel plate as shown FIG. 1 to FIG. 3 and shows a case where hot finished steel plate (steel strip) 1 having a plate thickness of 25 mm, a plate width of 4000 mm, and a temperature of 850° C. is descaled, then straightened and constrained and conveyed at a conveyance speed of 60 m/min between pairs of constraining rolls $\mathbf{2}_1$ and $\mathbf{2}_2$ during which cooling water was sprayed from the nozzles 3 of the groups of top and bottom surface nozzles 6*a* and 6*b* of the top/bottom surface nozzle group $\mathbf{6}_1$ arranged between the pairs of constraining rolls $\mathbf{2}_1$ and $\mathbf{2}_2$ so as to cool the steel plate 1 to 400° C. at a cooling rate of 30° C./sec.

In an actual cooling facility, after the top/bottom surface nozzle group $\mathbf{6}_1$ between the pairs of constraining rolls, the cooling is shared with the top/bottom surface nozzle groups arranged between a plurality of pairs of constraining rolls, but here, the example is shown of cooling by just the unit of the top/bottom surface nozzle group $\mathbf{6}_1$ between the pairs of constraining rolls.

In this Example, the steel plate cooling region of the group of top surface nozzles 6*a* of the top/bottom surface nozzle group $\mathbf{6}_1$ between the pairs of constraining rolls was divided to four regions of the spray impact part regions A and $A_1$, the entry side spray non-impact part region B, and the exit side spray non-impact part region C in the steel plate conveyance direction, the heat transfer coefficient was predicted for each divided region, and the amounts of sprayed cooling could be separately set and controlled in the spray impact part regions A and $A_1$. Accordingly, the division of the cooling region was based on the above Example 2 of Division of Regions.

Further, the steel plate cooling region in the steel plate width direction was divided into the three regions of the spray impact part region A (or $A_1$) and spray non-impact part regions Ea and Eb of the two side portions (mask portion regions) of the same in the conveyance direction, the heat transfer coefficient was predicted for each divided region, and the amounts of sprayed cooling water could be separately set and controlled in the spray impact part region A (or $A_1$), side portions $Ea_0$, $Eb_0$ of the region A, and side portions $Ea_1$, $Eb_1$ of the region $A_1$ (it may be considered to make $Ea_0$, $Eb_0$, $Ea_1$, and $Eb_1$ the spray impact part regions as well when they are not made mask portion regions).

On the other hand, in the group of bottom surface nozzles 6*b*, the steel plate cooling region was divided into the four regions of the spray impact part regions D and $D_1$, the entry side spray non-impact part region E, and the exit side spray non-impact part region F in the steel plate conveyance direction, heat transfer coefficients under these conditions were predicted based on the characteristics of the heat transfer coefficients found in advance by experiment for each of the divided regions, and amounts of sprayed cooling water could be separately set and controlled in the spray impact part regions D and $D_1$.

Further, in the steel plate width direction, the steel plate cooling region was divided into the three regions of the spray impact part region D (or $D_1$) in the conveyance direction and the spray impact part regions Ec and Ed at the two side portions thereof, the heat transfer coefficient was predicted for each divided region, and the amounts of sprayed cooling water could be separately set and controlled in the spray impact part regions D (or $D_1$), Ec, and Ed.

The working conditions and working results will be explained below together with the case according to a conventional example (Comparative Example). The "Conventional Example" referred to here is an example of the case of not dividing the steel plate cooling region of the groups of top and bottom surface nozzles of a top/bottom surface nozzle group between pairs of constraining rolls, predicting the heat transfer coefficient all together, and setting and controlling the amounts of cooling water from the groups of top and bottom surface nozzles of the top/bottom, surface nozzle group between the pairs of constraining rolls.

[Working Conditions]

Constraining roll diameter: 400 mm

Distance L between pairs of constraining rolls (steel plate cooling region): 1000 mm Area of steel plate cooling region: 4 $m^2$ (width of steel plate 1×distance between constraining rolls)

Group of top surface nozzles 6*a*

(Conveyance Direction)

Area of spray non-impact part region B on entry side: 1 $m^2$
(Length of B: 250 mm)

Areas of spray impact part regions A and $A_1$: 2 $m^2$ in total
(Lengths of A and $A_1$: 250 mm for each)

Spray impact area ratios of spray impact part regions A and $A_1$:
70% for each

Area of spray non-impact part region C on exit side: 1 $m^2$
(Length of C: 250 mm)

(Width Direction)

Areas of spray non-impact part regions $Ea_0$, $Eb_0$, $Ea_1$, and $Eb_1$ of side portions (mask portions): 0.125 $m^2$ for each
(Widths of $Ea_0$, $Eb_0$, $Ea_1$, and $Eb_1$: 250 mm for each)

Group of Bottom Surface Nozzles 6*b*

(Conveyance Direction)

Area of spray non-impact part region E on entry side: 0.8 $m^2$
(Length of E: 200 mm)

Areas of spray impact part regions D and $D_1$: 2.4 $m^2$ in total
(Lengths of D and $D_1$: 300 mm for each)

Spray impact area ratios of spray impact part regions D and $D_1$:
90% for each

Area of spray impact part region F on exit side: 0.8 $m^2$
(Length of F: 200 mm)

(Width Direction)

Areas of spray impact part regions Ec and Ed of side portions:
0.22 $m^2$ for each
(Widths of Ec and Ed: 220 mm for each)

In this Example, in the group of top surface nozzles 6*a*, the heat transfer coefficients on the top surface side required for securing the above-described cooling rate considering the divided regions A, $A_1$, $Ea_0$, $Eb_0$, $Ea_1$, and $Eb_1$ in the steel plate width direction ($Ea_0$, $Eb_0$, $Ea_1$ and $Eb_1$ become mask portions here, therefore are made spray non-impact part regions to which the spray water was not sprayed) and the divided regions B, A (or $A_1$), and C in the steel plate conveyance direction were predicted, and the steel plate temperature on the exit side of the top/bottom surface nozzle group $\mathbf{6}_1$ between the pairs of constraining rolls was made the target temperature 400° C. by making the densities of sprayed cooling water from the spray impact part regions A, $A_1$, $Ea_0$, $Eb_0$, $Ea_1$, and $Eb_1$ from the start of cooling to the end of cooling (note, the amounts of sprayed water are 0 in the $Ea_0$, $Eb_0$, $Ea_1$, and $Eb_1$ regions) as follows:

Region A: 1.3 $m^3/m^2$/min, and
Region $A_1$: 1.0 $m^3/m^2$/min and setting and controlling the conveyance speed to 60 m/min. The heat transfer coefficients of the divided regions here were predicted and set based on the following:

Region A: Line of 1.3 of FIG. 7
Region $A_1$: Line of 1.0 of FIG. 7
Region B: Line of 1.3 of FIG. 8
Region C: Line of 1.0 of FIG. 8
Regions $Ea_0$, $Eb_0$: Line of 1.3 of FIG. 8
Regions $Ea_1$, $Eb_1$: Line of 1.0 of FIG. 8

On the other hand, in the group of bottom surface nozzles 6*b*, the heat transfer coefficients on the bottom surface side required for securing the above-described cooling rate considering both of the divided regions Ec, D, $D_1$, and Ed in the steel plate width direction (here, Ec and Ed were defined as mask portions and made spray non-impact part regions) and the divided regions E, D, $D_1$, and F in the steel plate conveyance direction were predicted, and the steel plate temperature on the exit side of the top/bottom surface nozzle group $\mathbf{6}_1$ between the pairs of constraining rolls was made the target temperature 400° C. by setting and controlling the densities of sprayed cooling water from the spray impact part regions D, $D_1$, Ec, and Ed from the start of cooling to the end of cooling to:

Region D: 1.7 $m^3/m^2$/min
Region $D_1$: 1.3 $m^3/m^2$/min

The heat transfer coefficients of the divided regions here were predicted and set based on the following:

Region D: Line of 1.7 of FIG. 7
Region $D_1$: Line of 1.3 of FIG. 7
Regions Ec, Ed: Separately measured values of air cooling
Region E, region F: Separately measured values of air cooling When measuring the temperature of the top surface side and the temperature of the bottom surface side of the steel plate 5 seconds after being cooled by the groups of top and bottom surface nozzles of the top/bottom surface nozzle group $\mathbf{6}_1$ between the pairs of constraining rolls and passing through the downstream side constraining rolls $\mathbf{2}_2$, the temperature difference between the top surface side and the bottom surface side was ±10° C. with respect to the target temperature 400° C., that is, the uniformity was high, and steel plate 1 having extremely small warping and residual stress, excellent in both shape and material quality, and sufficiently satisfactory could be obtained.

These results are possible by dividing the steel plate cooling region in the steel plate conveyance direction and the steel plate width direction into a plurality of regions having clearly different heat transfer coefficients to raise the precision of prediction of the heat transfer coefficients and making the difference of the steel plate temperature histories from the start of cooling to the end of cooling in the width direction portions and top and bottom surfaces smaller.

Note that the steel plate temperature was measured here at the center portion excluding the edge portion regions (width: 10 mm) corresponding to 2 times the plate thickness from the end portions of the steel plate.

Further, when producing 1200 steel plates having the same plate width as that of this steel plate and having thicknesses of 15 to 40 mm while changing the conveyance speed within a range from 40 to 90 m/min, a fluctuation of ±20° C. occurred in the cooling start temperature 850° C., but the resultant standard deviation of the cooling stop temperature was a good 10° C.

COMPARATIVE EXAMPLE

This Comparative Example differs in working conditions from Example 1 in the points of not dividing the steel plate cooling regions of the groups of top and bottom surface nozzles 6*a* and 6*b*, but predicting the heat transfer coefficients all together and setting and controlling the amounts of the sprayed coolant all together in the spray impart part regions. On this top surface side, the amount of sprayed coolant is the same as that in the Example as a total amount.

In the group of top surface nozzles 6*a*, the heat transfer coefficient of the steel plate top surface side required for securing the above-described cooling rate was predicted (here, the heat transfer coefficient of the top surface side was predicted by assuming 0.65 $m^3/m^2/min$ (mean value) in FIG. 6), the amounts of sprayed cooling water from the spray impact part regions $A+A_1$ were set, and the amounts of sprayed cooling water were set and controlled from the start of cooling to the end of cooling in order to make the steel plate temperature on the exit side of the top/bottom surface nozzle group $\mathbf{6}_1$ between the pairs of constraining rolls the target temperature 400° C.

On the other hand, in the group of bottom surface nozzles 6*b*, the heat transfer coefficient of the facing top surface side of the steel plate was predicted, and the amounts of sprayed cooling water from the spray impact part regions $D+D_1$, Ec, and Ed were set and controlled based on this predicted value so as to make the steel plate temperature history from the start of cooling to the end of cooling approach the temperature history of the facing top surface side of the steel plate.

When measuring the temperature of the top surface side and the temperature of the bottom surface side of the steel plate 5 seconds after being cooled by the groups of top and bottom surface nozzles of the top/bottom surface nozzle group $\mathbf{6}_1$ between the pairs of constraining rolls and passing through the downstream side constraining rolls $\mathbf{2}_2$, the temperature difference between the top surface side and the bottom surface side was ±20° C. with respect to the target temperature 400° C., that is, the fluctuation width was large, the warping and residual stress were large, and steel plate excellent in uniformity in both shape and quality could not be stably obtained.

Further, when producing 1200 steel plates having the same plate width as that of this steel plate and having thicknesses of 15 to 40 mm by a target cooling stop temperature of 400° C., there was a fluctuation of ±18° C. in the cooling start temperature 850° C. and the standard deviation of the resultant cooling stop temperature was 25° C. This was larger in comparison with the Example of the present invention.

Note that the steel plate temperature history from the start of cooling to the end of cooling in this comparative example clearly differed in the width direction portions. There were similar differences at the top and bottom surfaces as well.

The main cause of this is believed to be that heat transfer coefficients were set all together (average) and the amounts of sprayed cooling water were set and controlled irrespective of there being portions having clearly different heat transfer coefficients in the steel plate cooling region in the steel plate conveyance direction.

The present invention is not limited to the contents of the examples described above. For example, the part regions divided, the types (structures) and arrangements (number and alignment) conditions of nozzles constituting the groups of top and bottom surface nozzles, the coolant spray conditions from the nozzles, the diameters of the constraining rolls, the arrangement conditions, the presence/absence of edge masks, and so on change within the scope of the claims in accordance with the size (particularly thickness) of the target steel plate, temperature, conveyance speed, target cooling temperature, cooling time (cooling rate), and so on.

Further, the above embodiments only show specific examples of working the present invention. They should not be used to interpret the technical scope of the present invention in a limited manner. That is, the present invention may be carried out in various ways without departing from its technical idea and main features.

Explanation of Notations

1. Steel plate
$\mathbf{2}_1$, $\mathbf{2}_2$. Pairs of constraining rolls
2*a*. Top roll
2*b*. Bottom roll
3, $\mathbf{3}_1$, $\mathbf{3}_2$. Nozzles
3*a*. Coolant spray
3*b*. Plate top coolant flow
3*s*. Spray impact surface
4. Hot finishing mill
5. Descaling apparatus
$\mathbf{6}_1$, $\mathbf{6}_2$. Top/bottom nozzle groups between pairs of constraining rolls
6*a*. Group of top surface nozzles
6*b*. Group of bottom surface nozzles
7. Straightener
8. Conveyance speed meter
9. Thermometer
10. Processing apparatus
11. Setting unit
12. Coolant controller
13. Edge mask
L. Distance between pairs of constraining rolls (length of steel plate cooling region)
W. Steel plate width

[TOP SURFACE SIDE]

A. Spray impact part region (upstream side)
$A_1$. Spray impact part region (downstream side)
B. Spray non-impact part region (upstream side)
C. Spray non-impact part region (downstream side)
BC. Spray non-impact part region (between A and $A_1$)
Ea, Eb. Width direction side regions (side parts of spray impact part region)
$Ea_0$, $Eb_0$. Upstream side
$Ea_1$, $Eb_1$. Downstream side

[BOTTOM SURFACE SIDE]

D. Spray impact part region (upstream side)
$D_1$. Spray impact part region (downstream side)
B. Spray-nonimpact part region (upstream side)
F. Spray-nonimpact part region (downstream side)
Ec, Ed. Width direction side regions (side parts of spray impact part region)

The invention claimed is:

1. A method of controlled cooling of a steel plate using a cooling apparatus having a plurality of pairs of constraining rolls, each comprised of a top roll and a bottom roll, for constraining and conveying hot rolled steel plate, and groups of top and bottom surface nozzles having nozzles arranged in one line or a plurality of lines in a steel plate width direction and spraying a cooling medium to the top and bottom surfaces of the steel plate conveyed between pairs of constraining rolls adjoining each other in the front and back of the cooling apparatus in a steel plate conveyance direction, said method of cooling the steel plate characterized by:

dividing a region of the steel plate cooled by the groups of top and bottom surface nozzles between pairs of constraining rolls into at least a spray impact part region, wherein said spray impact part region is beneath the top surface nozzles or directly above the bottom surface nozzles, and spray non-impact part regions, wherein said spray non-impact part regions are regions other than the spray impact part region, computing predicted temperature histories of the steel plate based on previously predicted heat transfer coefficients of the divided regions, and controlling the amounts of the sprayed cooling medium on the spray impact part region from the groups of top and bottom surface nozzles between the pairs of constraining rolls so that the top and bottom surface temperatures of the steel plate at the outlet side of the cooling apparatus given by computing predicted temperature histories of the steel plate become a target temperature.

2. A method of cooling a steel plate as set forth in claim 1 characterized by:

dividing the spray impact part region of the steel plate cooling region of the groups of top and bottom surface nozzles between the pairs of constraining rolls into two or more regions in a steel plate conveyance direction and controlling the amounts of the sprayed cooling medium from the groups of top and bottom surface nozzles in units of those divided regions.

3. A method of cooling a steel plate as set forth in claim 1 or 2 characterized by:

dividing at least the spray impact part region of the steel plate cooling region between the pairs of constraining rolls into two side end regions and an inside region between these two side end regions in the steel plate width direction, computing predicted temperature histories in the steel plate width direction based on previously set heat transfer coefficients of the divided regions, and controlling the amounts of the sprayed cooling medium on the spray impact part region from the groups of top and bottom surface nozzles in the steel plate width direction between the pairs of constraining rolls so that the top and bottom surface temperatures of the steel plate at the outlet side of the cooling apparatus given by computing predicted temperature histories of the steel plate become a target temperature.

* * * * *